United States Patent [19]

Aarons

[11] 4,106,253

[45] Aug. 15, 1978

[54] TILING SYSTEM FOR ROOFS

[75] Inventor: Raymond Joseph Aarons, Jindalee, Australia

[73] Assignee: Monier Colourtile Pty. Ltd., Darra, Australia

[21] Appl. No.: 753,109

[22] Filed: Dec. 21, 1976

[30] Foreign Application Priority Data

Dec. 24, 1975 [AU] Australia ..... PC4388

[51] Int. Cl.[2] ..... E04D 1/34

[52] U.S. Cl. ..... 52/547; 52/550

[58] Field of Search ..... 52/90, 92, 726, 348–350, 52/357–361, 478, 546–550; 403/244, 400, 188, 190, 191, 237, 257, 387, 233, 263, 230

[56] References Cited

U.S. PATENT DOCUMENTS

| | | | |
|---|---|---|---|
| 1,988,688 | 4/1935 | Robinson et al. | 52/361 |
| 2,101,952 | 12/1937 | Olsen | 52/349 |
| 2,485,090 | 10/1949 | Finch | 403/400 |
| 2,877,879 | 3/1959 | Johnson | 52/547 |
| 3,035,672 | 5/1962 | Tuten et al. | 52/726 |
| 3,144,733 | 8/1964 | Balinski | 52/357 |
| 3,536,345 | 10/1970 | Leifer | 403/244 |

FOREIGN PATENT DOCUMENTS

| | | | |
|---|---|---|---|
| 18,287 of | 1904 | United Kingdom | 52/478 |

*Primary Examiner*—James L. Ridgill, Jr.
*Attorney, Agent, or Firm*—Haseltine, Lake & Waters

[57] ABSTRACT

A tiling system for roofs comprising a metal tiling batten within which the upstanding lug of a bracket is slidably attached, the bracket being fixed to a roof-rafter. The system may use standard batten lengths connected end-to-end by butt-joiners engaged within the batten ends. Tile clips may engage the edges of tiles and a groove or grooves in the battens. The system is applicable to hip or valley roof construction.

9 Claims, 10 Drawing Figures

10
11
11A
12
15
20
21
22
30
31
32
33
34
40
41
42
43
44
45
50
51
52
53
54
55

TILING SYSTEM FOR ROOFS

BACKGROUND OF THE INVENTION

This invention relates to a system for fixing tiles to a roof structure, using metal tiling battens instead of timber tiling battens, as have been used hitherto.

The availability of timber roof tiling battens is affected by climatic conditions and diminishing resources of natural timber stocks to the extent that a substitute in the form of metal is the obvious solution to the ultimate scarcity problem of this very important component of roof tile cladding of domestic and other buildings.

Timber tiling battens are not normally regarded by the timber industry as regular constructional items and as such they are usually cut from the wastage section of trees after normal structural sections have been milled.

This fact alone affects the quality, available lengths and regularity of supply of timber battens and creates major problems for the roof tiling industry particularly in ensuring sufficient holding stocks to suit the building rate, the necessity of speedy turnover of stock before undue weathering has affected the quality and the obvious yard and on site wastage which must of course be recovered in the selling price to the consumer.

Distribution of job lots to building sites is costly due to bulkiness of pack sizes and weight.

Further, the variations in available lengths and quality of the timber causes on site wastage to be as high as 15% on the majority of projects. This also is a cost factor to be incurred by the consumer.

With the recent introduction of metal roof trusses in the domestic building industry, roofing companies and contractors are experiencing difficulties in the application of timber tiling battens to steel rafters, and, as a result the labor cost for this item has been increased.

Further, there have been recent changes in the building regulations concerning the security of timber batten connections to roof rafters, particularly in the designated high wind areas and as such traditional methods of securing timber tiling battens with standard nails is now suspect and specifications are being and will continue to provide for more proven systems of connection such as screwing, bolting strapping or other fasteners which, of course, will, if enforced, add considerably to the labor cost of application of timber battens in these areas.

As the spacing of roof rafters and trusses varies from 600mm to 900mm, different sizes of timber tiling battens need to be stocked and delivered according to the particular rafter spacings of the project.

The labor involved in application of timber tiling battens to a roof structure which is to be sarked with a waterproof membrane increases considerably and is thus a more costly item to the consumer. Furthermore, the traditional method of setting out tiling batten spacings on roof rafters by means of nails being partially driven into the top face of the rafter is not only a safety hazard to the contractor but causes damage to the sarking membrane during application by undue tearing which needs to be sealed to prevent water penetration.

SUMMARY OF THE PRESENT INVENTION

It is an object of this invention to provide a system using metal tiling battens to avoid the above disadvantages of timber tiling battens. It is a further object to enable such metal battens to be mounted on either timber or metal rafters or trusses of a roof.

Accordingly, the invention comprises a tiling system for roofs including a sheet metal tiling batten and a bracket attaching said batten to a roof-rafter characterized in that said batten is formed with a top, side-walls and a groove extending inwardly below each side-wall, and said bracket carries an upstanding lug to fit slidably within said batten between its top and said grooves and to extend downwardly between said grooves to below said batten.

As will be further explained below, the invention may be used in conjunction with special components such as butt-joiners for battens, and roof tile-holding clips.

The system of the invention may also be used for hip and valley construction in a roof. In this embodiment, special hip/valley battens are provided into which the ends of the tiling battens fit without cutting or mitering.

BRIEF DESCRIPTION OF THE DRAWINGS

In order that the invention may be better understood a particular embodiment will be described with reference to the accompanying drawings, in which.

DETAILED DESCRIPTION OF THE INVENTION

Metal batten 10 is roll-formed preferably of steel and has a top profiled longitudinally for rigidity and strength and the center profile is grooved at 13 to permit easier location and penetration of a nail as an alternative method of attachment of batten 10 to timber rafters. Lower double-flanges 11 below side-walls 12 present outwardly-faced grooves 11A at each side.

Figure 9:
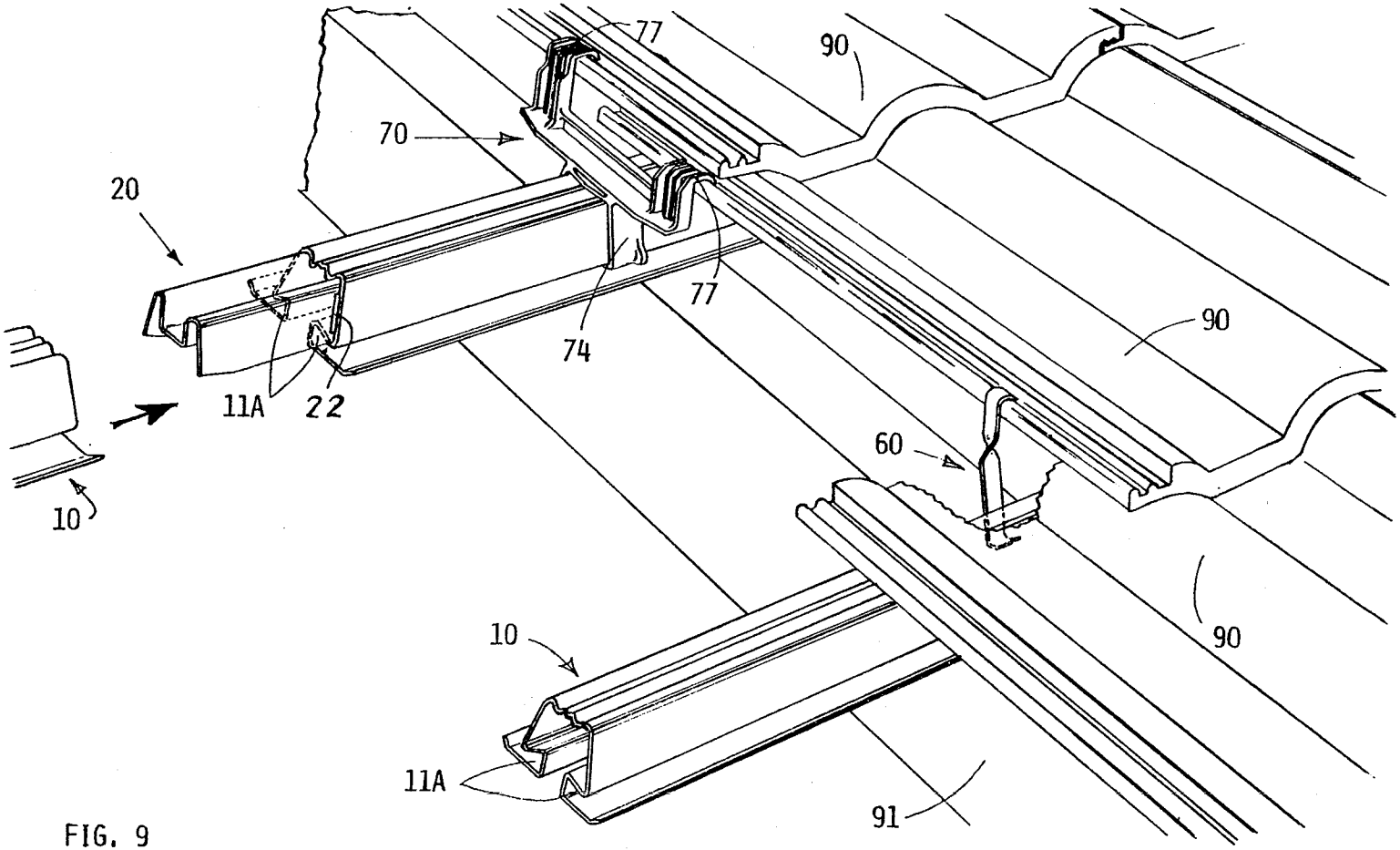
FIG. 9 shows the assembled arrangement of tile battens and tiles.

Butt-joiner 20 (FIG. 2) is of generally M-section with side-walls 21 adapted to slide into adjacent ends of battens 10 between walls 12 and above grooves 11A (as shown in FIG. 9) with upright locating ribs 22 lying between the ends of the battens 10. Battens 10 can therefore be made in standard lengths (e.g. multiples of 900mm) and be rigidly formed by butt-joiner 20 at points other than over rafters or trusses. Cutting to length to join over rafters or trusses is thus unnecessary.

Figures 1, 2, 3, 4, 5:
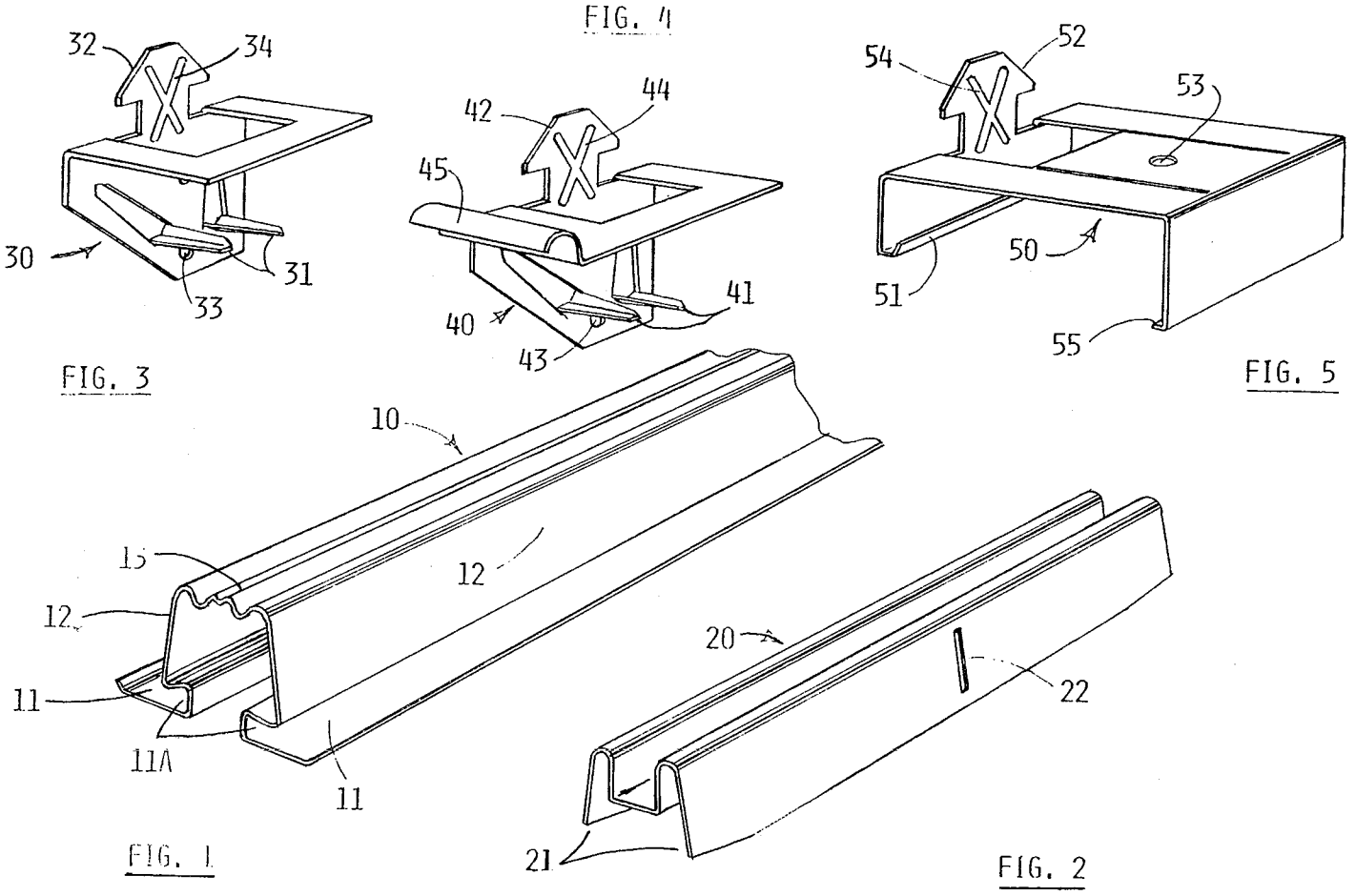
FIG. 1 shows a metal tile according to the invention.
FIG. 2 shows a butt-joiner for the battens of FIG. 1.
FIGS. 3, 4, and 5 show alternative forms of attachment brackets for wooden and metal rafters respectively.

The bracket 30 of FIG. 3 has self nailing prongs 31 for fixing to the vertical face of a wooden rafter as well as holes 33 which may be used for additional fixing to wooden rafters by means of standard nails.

Bracket 40 in FIG. 4 is similar to bracket 30, reference numerals 41 to 44 corresponding to reference numerals 31 to 34 of FIG. 3. However, an additional extended horizontal flange 45 is provided of curved semicircular shape to engage an existing metal ridge track and ridge capping system (not shown).

Bracket 50 in FIG. 5 has a flange 51 to fit around the flange of a Z-section steel rafter and a "friction-fit" bead or flange 55 to engage the opposite face of the steel rafter. A hole 53 may be provided for screwing bracket 50 to the top face of the metal rafter for added securement.

Figure 10:
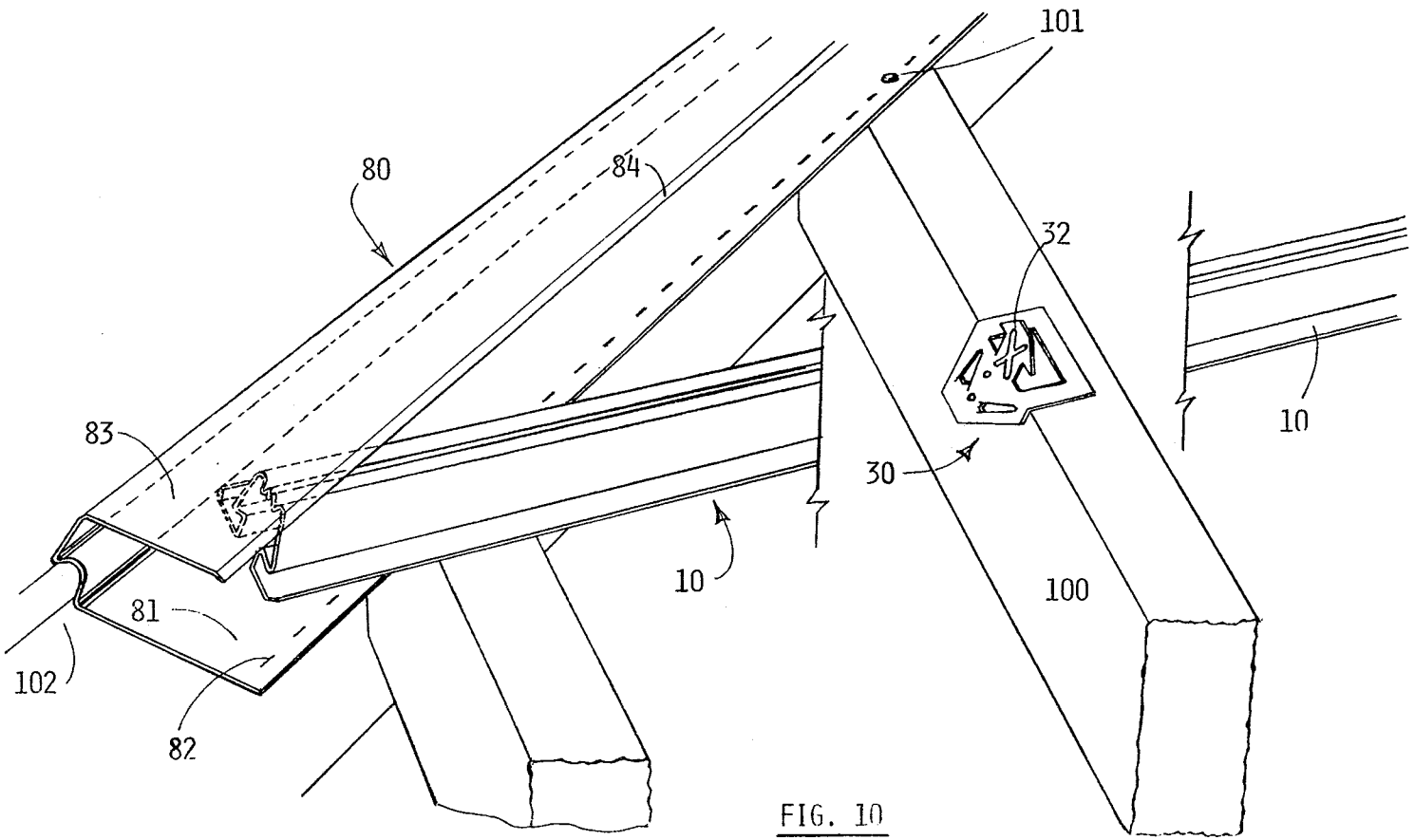
FIG. 10 shows a similar arrangement at a hip or valley, partly broken away.

All brackets 30, 40 and 50 have an upright lug 32, 42 or 52 which engages within battens 10 to hold them firmly to the rafters (FIG. 10). Each upright lug is reinforced by means of a 'X' embossing 34, 44 and 54 for rigidity.

Figure 6:
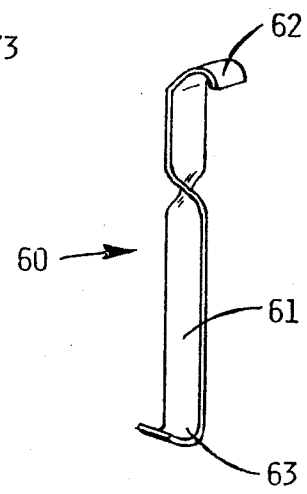
FIGS. 6 and 7 show alternative tile clips for metal battens.

The tile clip 60 of FIG. 6 has a body 61 twisted through 90°, an upper hook 62 to engage the edge of a tile (FIG. 9) and a lower hook 63. Hook 63 fits within the re-entrant groove 11A of a flange 11 of the metal batten 10. This clip is used when tiles are laid in broken bond fashion.

Figure 7:
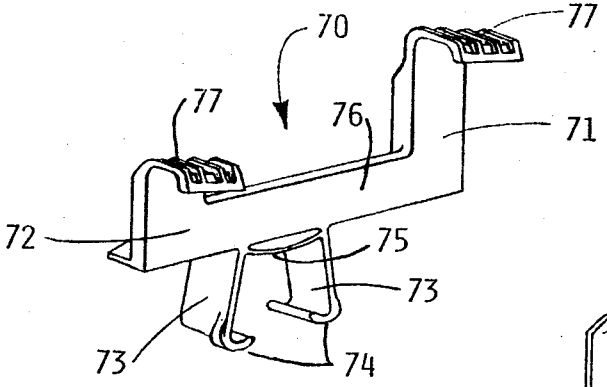

Tile clip 70 of FIG. 7 embodies two downward-sloping legs 73 at the bottom of which are opposed hooks 74 which clip into the re-entrant grooves 11A of the metal batten 10.

At the top of the downward legs is a "bridge" 75 which acts as a pressure pad to ensure positive locking of the hook 74 into the grooves of batten 10. A flange 76 connects the lower downward legs to two upper legs 71 and 72 at the upper end of each of which is located a hook 77 which engages the edge of tiles at the point where they overlap directly above the batten 10 (as shown in FIG. 9).

The bodies of the upper legs 71 and 72 are ribbed for rigidity and strength.

Clip 70 is used only when tiles are laid in straight bond fashion.

Figure 8:
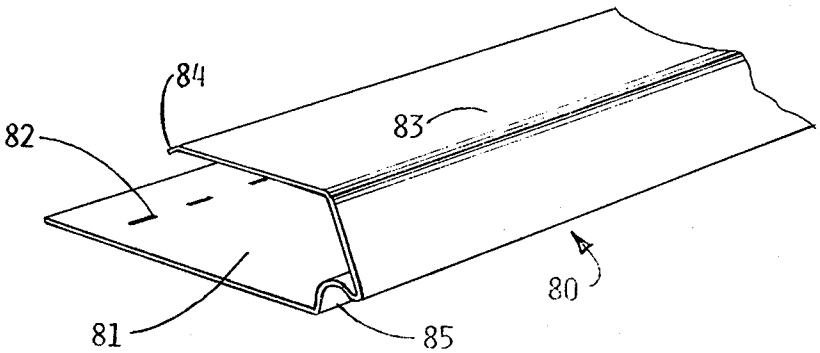
FIG. 8 shows a hip or valley batten.

The valley/hip batten 80 of FIG. 8 has a lower flange 81 with slots 82 for nailing or screwing to rafters, a narrower upper flange 83 having a downwardly-inclined lip 84 at its free edge, and a part circular edge-profile 85.

Normally two battens 80 would be placed back-to-back, one on each side of a hip board or in the case of a valley application one each against the two edges of the valley board.

Referring to FIG. 9, a batten 10 is shown fixed to a wooden rafter 91, with a butt-joiner 20 connecting it to a second batten 10.

A tile clip 60 (FIG. 6) has its upper hook 62 engaged over the bead of a tile 90 and its lower hook 63 engaged within groove 11A of batten 10.

A third batten 10 is shown with a tile clip 70 in position with the lower downward leg hooks 74 engaged within grooves 11A and the upper hooks 77 engaged over the beads of the two tiles 90 where they overlap directly above the batten 10, the hooks 77 being of different height to engage the overlapped tiles.

FIG. 10 shows the fixing by a bracket 30 of a batten 10 (shown partly broken away for clarity) to a wooden rafter 100.

A hip or valley batten 80 is nailed at 101 to rafter 100 and lies against a hip-or-valley-board 102. The end of tile batten 10 fits tightly between upper and lower flanges 81, 83 of batten 80 with lip 84 clipping batten 10 in place.

It will be seen that the end of batten 10 needs no angle-cutting nor any further means of attachment.

It will be understood that various changes and modifications may be made in the arrangements described and claimed without departing from the invention.

I claim:

1. A tiling system for roofs including a sheet metal tiling batten, a bracket attaching said batten to a roof-rafter, said batten being formed with a top, side-walls and a groove extending inwardly below each side-wall, said bracket carrying an upstanding lug shaped to fit within said batten between its top and said grooves and to extend downwardly between said grooves to below said batten and a tile clip engaging said batten and holding overlapping adjacent roof tiles against said batten, said tile clip comprising two spaced hooks extending upwardly and of different height engaging respective side edges of the overlapping adjacent roof tiles, and opposed lower hooks engaging in both grooves of said batten.

2. A tiling system as claimed in claim 1 wherein in said batten has outward flanges below said grooves.

3. A tiling system as claimed in claim 1, wherein said batten is formed of batten lengths connected end-to-end by a butt-joiner slidably engaged within abutting ends of said lengths and retained between the top and the grooves thereof.

4. A tiling system as claimed in claim 1, wherein the end of said batten lies within the bight of a C-section member forming a valley-iron of said roof.

5. A tiling system as claimed in claim 1, wherein the end of said batten lies within the bight of a C-section member forming a hip-iron of said roof.

6. A tiling system as claimed in claim 1, wherein said bracket includes integral horizontal prongs for piercing attachment with a wood rafter, and a horizontal shelf member for resting on and positioning the bracket in the rafter, said bracket including embossed reinforcing means.

7. A tiling system as claimed in claim 1, wherein said bracket carries a first plate at right angles to said lug to lie between said batten and a roof rafter.

8. A tiling system as claimed in claim 7, wherein said bracket further carries a second plate connected at right angles to said first plate and lying in the plane of said lug and fastening means on said second plate to engage the side of said rafter.

9. A tiling system as claimed in claim 7, wherein said bracket carries second and third plates connected on opposite edges of said first plate at right angles to said first plate to clip around either side of a metal rafter.

* * * * *